US008540271B2

(12) United States Patent
Chou et al.

(10) Patent No.: US 8,540,271 B2
(45) Date of Patent: Sep. 24, 2013

(54) SNOWSHOE BINDING

(76) Inventors: Windsor Chou, Taipei (TW); John Martin, Vashon, WA (US)

( * ) Notice: Subject to any disclaimer, the term of this patent is extended or adjusted under 35 U.S.C. 154(b) by 98 days.

(21) Appl. No.: 13/233,108

(22) Filed: Sep. 15, 2011

(65) Prior Publication Data

US 2013/0069341 A1 Mar. 21, 2013

(51) Int. Cl.
*A63C 9/00* (2006.01)

(52) U.S. Cl.
USPC ..... 280/617; 24/589.1; 24/593.1; 280/616; 280/623; 280/624

(58) Field of Classification Search
USPC ..... 24/589.1, 593.1; 280/616, 617, 280/623, 624
See application file for complete search history.

(56) References Cited

U.S. PATENT DOCUMENTS

| | | | | |
|---|---|---|---|---|
| 5,048,855 | A * | 9/1991 | Girault et al. | 280/615 |
| 5,185,908 | A * | 2/1993 | Oetiker | 24/20 R |
| 7,503,579 | B2 * | 3/2009 | Couderc | 280/623 |
| 2002/0089151 | A1 * | 7/2002 | Carrasca | 280/617 |

* cited by examiner

*Primary Examiner* — John R Olszewski
*Assistant Examiner* — Hilary L Johns
(74) *Attorney, Agent, or Firm* — Rosenberg, Klein & Lee

(57) ABSTRACT

A snowshoe binding includes a base plate having opposing first and second lateral sides and a locating block located on the second lateral side and defining an inverted T-shaped retaining hole, a flat connection block defining therein a bottom accommodation chamber adapted for accommodating the locating block, a plurality of binding strap each having a first end connected to the first lateral side of the base plate and a second end coupled to the flat connection block, and a locking device adapted for detachably locking the flat connection block to the locating block.

6 Claims, 7 Drawing Sheets

SNOWSHOE BINDING

BACKGROUND OF THE INVENTION

1. Field of the Invention

The present invention relates to snowshoe binding technology and more particularly, to a snowshoe binding, which quick fastening of the snowshoe to the snowboard and unfastening of the snowshoe from the snowboard.

2. Description of the Related Art

A conventional snowshoe binding 6, as illustrated in FIGS. 12 and 13, uses ratchets 63 to adjustably locking respective toothed strips 62 to toe and upper straps 61, thereby securing the snowshoe. When going to separate the snowshoe from the snowshoe binding 6, it is necessary to loosen the ratchets 63 and then to pull the toothed strips 62 apart from the toe and upper straps 61. When fastening the snowshoe, the user must insert the toothed strips 62 through the respective ratchets 63 at the toe and upper straps 61. As the user wears heavy clothes and gloves when snowboarding, it is inconvenient to fasten or unfasten this design of snowshoe binding.

SUMMARY OF THE INVENTION

The present invention has been accomplished under the circumstances in view. It is the main object of the present invention to provide a snowshoe binding, which is easy to operate, facilitating quick snowshoe mounting and dismounting.

To achieve this and other objects of the present invention, a snowshoe binding comprises a base plate having opposing first and second lateral sides and a locating block located on the second lateral side and defining an inverted T-shaped retaining hole, a flat connection block defining therein a bottom accommodation chamber adapted for accommodating the locating block, a plurality of binding strap each having a first end connected to the first lateral side of the base plate and a second end coupled to the flat connection block, and a locking device adapted for detachably locking the flat connection block to the locating block.

Further, the locking device comprises a male buckle mounted in the flat connection block for hooking up with the locating block at the base plate, a press member coupled to the male buckle and operable to move the male buckle from the engaged position to a disengaged position for allowing separation of the flat connection block from the locating block, and a spring member set between the male buckle and the press member.

DETAILED DESCRIPTION OF THE PREFERRED EMBODIMENT

Referring to FIGS. 1-4, a snowshoe binding in accordance with a first embodiment of the present invention is shown comprising a base plate 1, a flat connection block 2, two binding straps (one toe strap and one upper strap) 11 each having one end fixedly connected to one lateral side of the base plate 1 and an opposite end adjustably coupled to the flat connection block 2 by an adjustment buckle 111, a locating block 12 fixedly located on the other lateral side of the base plate 1, and a locking device for detachably locking the flat connection block 2 to the locating block 12.

Figure 1:
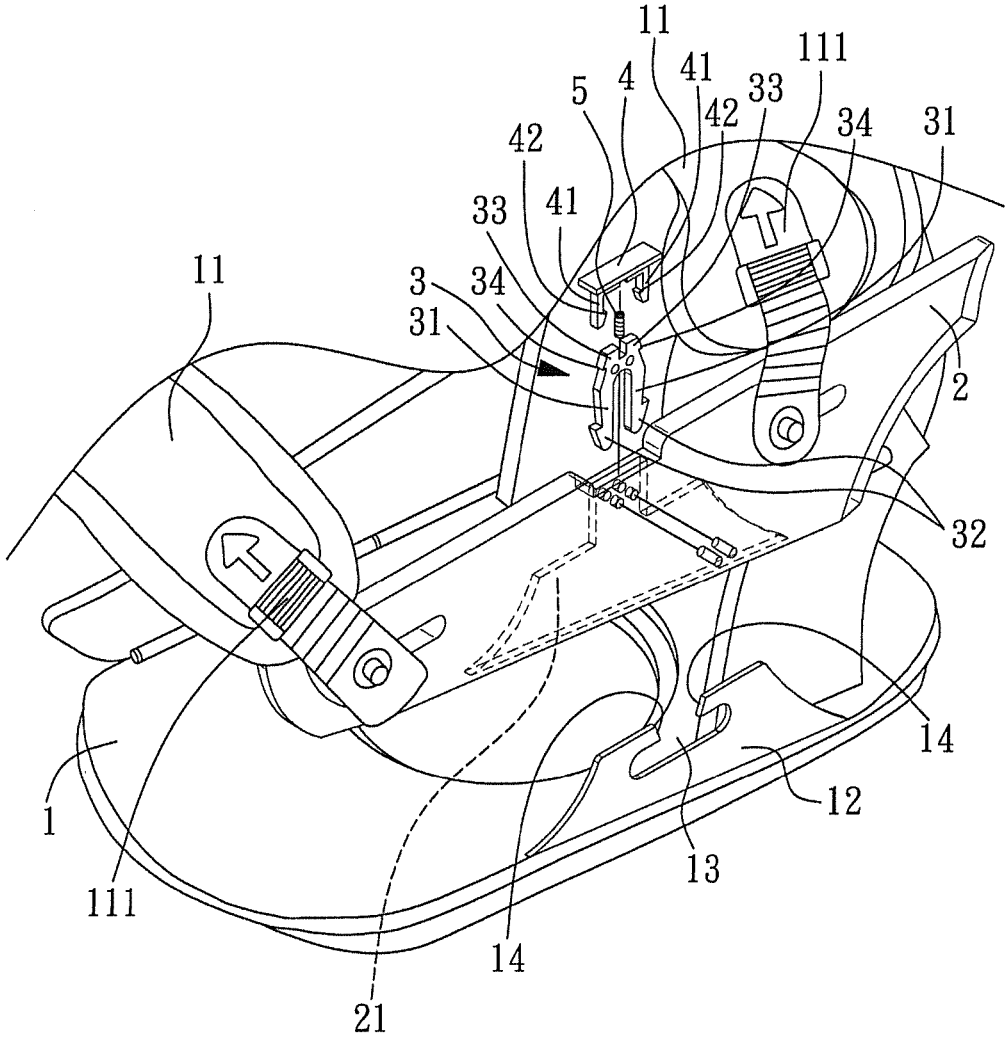
FIG. 1 is a perspective exploded view of a part of a snowshoe binding in accordance with a first embodiment of the present invention.
Figure 2:
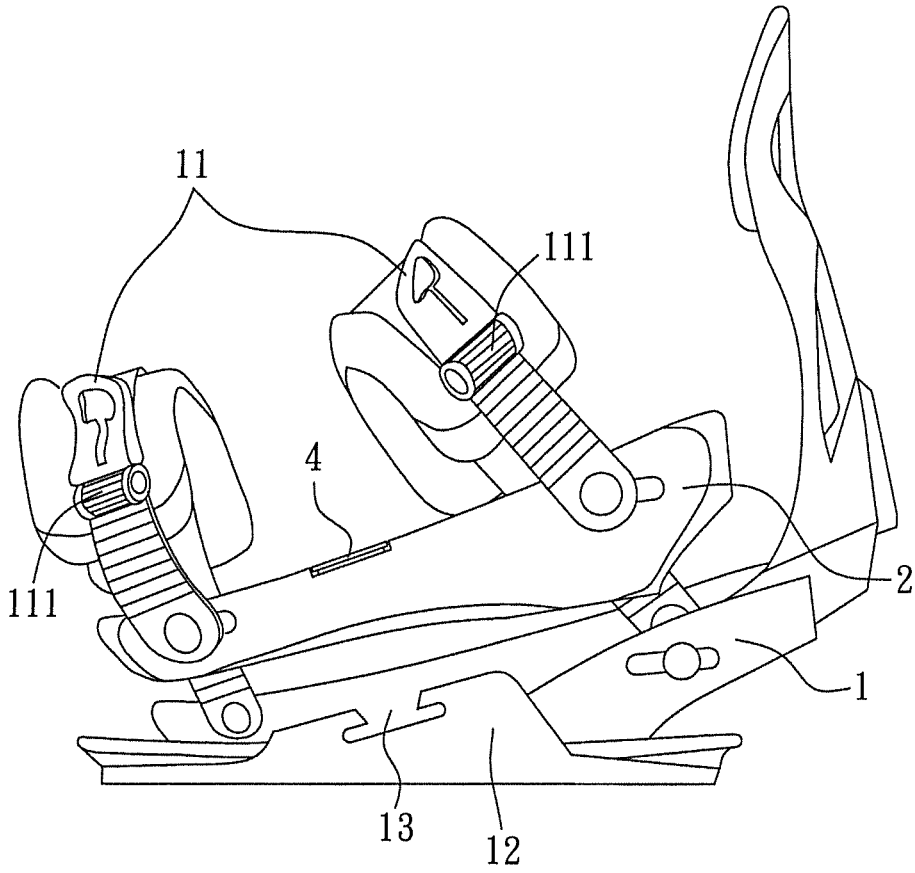
FIG. 2 is a side view of the first embodiment of the present invention, illustrating the flat connection block disconnected from the locating block.
Figure 3:
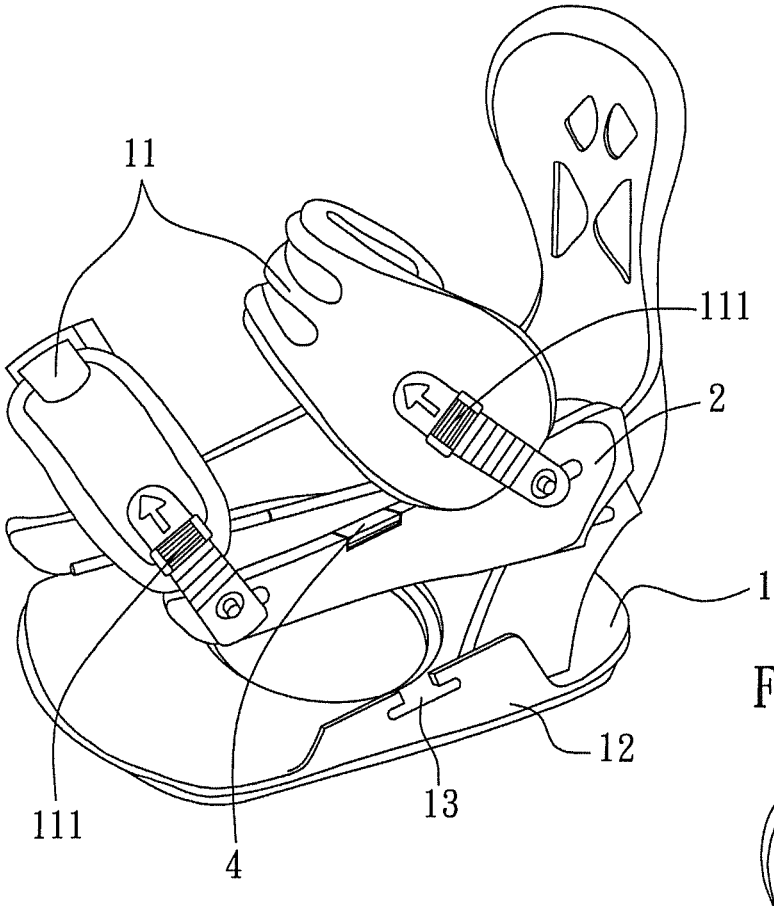
FIG. 3 is an oblique side elevation of FIG. 2.
Figure 4:
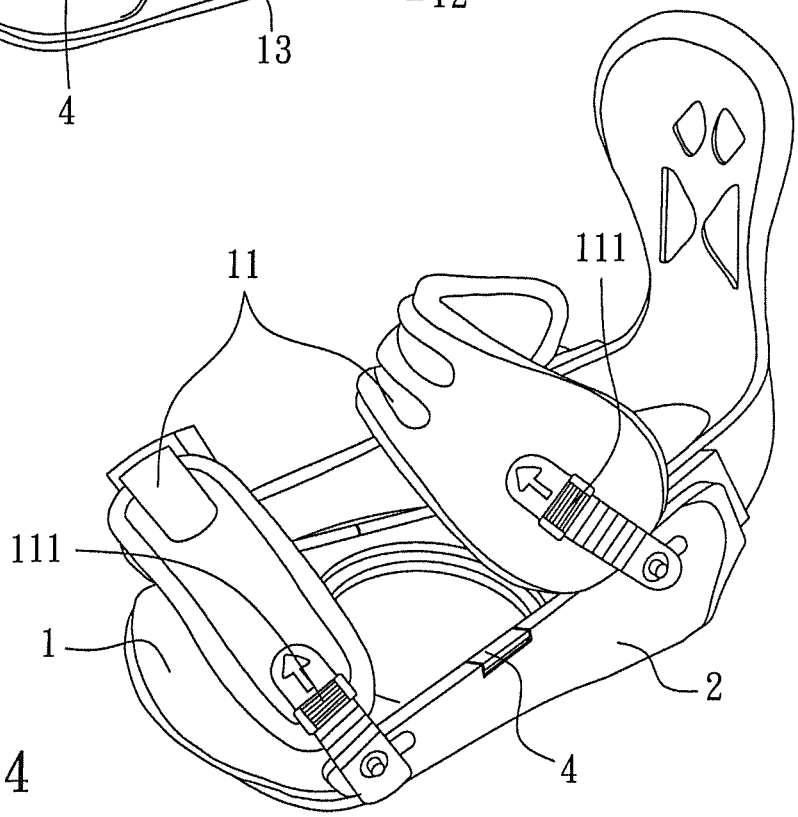
FIG. 4 corresponds to FIG. 3, illustrating the flat connection block disconnected from the locating block.
Figure 5:
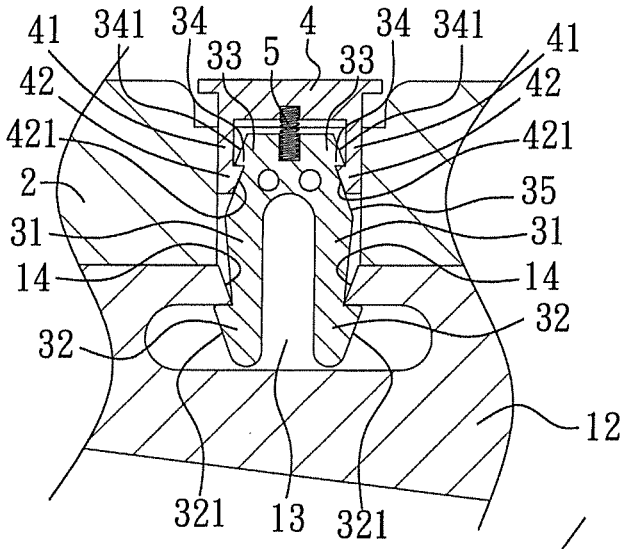
FIG. 5 is a sectional view of a part of the first embodiment of the present invention, illustrating the male buckle locked to the inverted T-shaped hole of the locating block.
Figure 6:
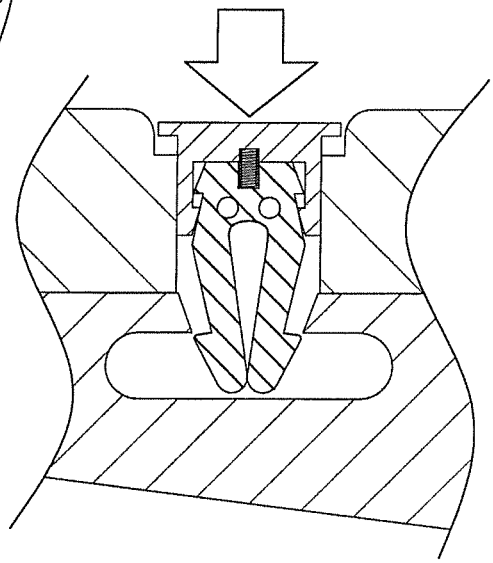
FIG. 6 corresponds to FIG. 5, illustrating the springy arms of the male buckle squeezed and the outwardly protruding hooked portions moved toward each other.
Figure 7:
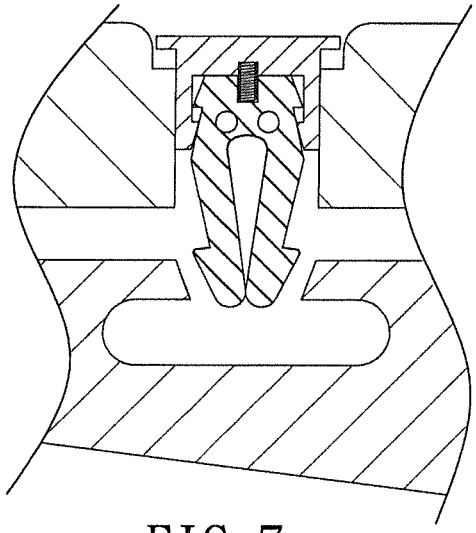
FIG. 7 corresponds to FIG. 6, illustrating the outwardly protruding hooked portions of the male buckle disengaged from the inverted T-shaped hole of the locating block.

The flat connection block 2 defines a bottom accommodation chamber 21 for receiving the locating block 12. The locating block 12 comprises an inverted T-shaped retaining hole 13 located on the top side thereof and two beveled guide edges 14 disposed at two opposite lateral sides of the top entrance of the inverted T-shaped retaining hole 13 and sloping downwardly toward the center of the inverted T-shaped retaining hole 13. The aforesaid locking device comprises a press member 4, a male buckle 3, and a spring member 5 set between the press member 4 and the male buckle 3. The male buckle 3 is fixedly mounted in the bottom accommodation chamber 21 of the flat connection block 2 at the top side, comprising two coupling blocks 33 connected together, two hook blocks 34 respectively located on the bottom sides of the two coupling blocks 33, two springy arms 31 respectively downwardly extended from the bottom sides of the upper hook blocks 34 in a parallel manner and respectively terminating in an outwardly protruding hooked portion 32 for hooking up with the inverted T-shaped retaining hole 13 to lock the flat connection block 2 to the locating block 12, and two beveled guide edges 341 respectively downwardly extended from the bottom edges of the hook blocks 34 along the respective outer lateral sides of the springy arms 31. The outwardly protruding hooked portion 32 has a beveled guide face 321 disposed at an outer side and fitting the beveled guide edges 14 of the locating block 12. By means of attaching the respective beveled guide faces 321 to the respective beveled guide edges 14, the outwardly protruding hooked portions 32 of the male buckle 3 can easily and positively be forced into engagement with the inverted T-shaped retaining hole 13 of the locating block 12. The press member 4 comprises two coupling arms 41 downwardly extended from the bottom side thereof in a substantially parallel manner and respectively terminating in a respective inwardly protruding hook block 42 that has a beveled bottom actuation edge 421. The spring member 5 is set between the bottom side of the press member 4 and the top side of the junction between the coupling blocks 33 of the male buckle 3. During installation, attach the beveled bottom actuation edges 421 of the inwardly protruding hook blocks 42 of the press member 4 to the respective outer lateral sides of the coupling blocks 33, and then impart a downward pressure to the press member 4 to force the inwardly protruding hook blocks 42 into engagement with the respective bottom edges of the hook blocks 34. Thus, the press member 4 is coupled to the male buckle 3. When continuously force down the press member 4 relative to the male buckle 3, the beveled bottom actuation edges 421 of the inwardly protruding hook block 42 will be moved downwardly along the beveled guide edges 341 of the hook blocks 34 to squeeze the two springy arms 31 toward each other (see FIG. 6), causing relative movement between the beveled edges 35 of the two springy arms 31 and moving the outwardly protruding hooked portions 32 of the male buckle 3 from the engaged position shown in FIG. 5 to the disengaged position shown in FIG. 7. When the outwardly protruding hooked portions 32 of the male buckle 3 are kept in the disengaged position, the user can move the male buckle 3 in and out of the inverted T-shaped retaining hole 13 of the locating block 12 to lock the flat connection block 2 to the locating block 12, or to unlock the flat connection block 2 from the locating block 12.

Figure 8:
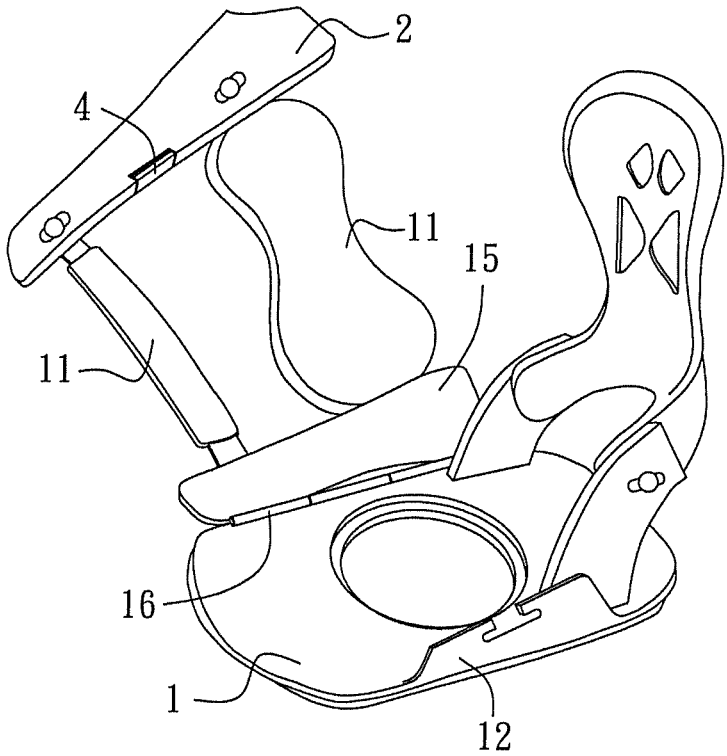
FIG. 8 is an extended out view of a part of a snowshoe binding in accordance with a second embodiment of the present invention.
Figure 9:
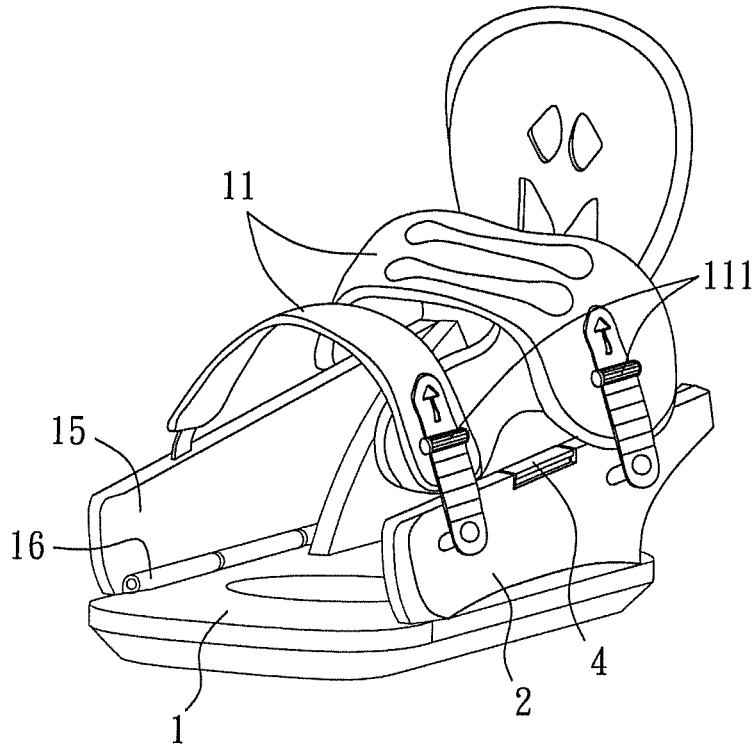
FIG. 9 is an elevational assembly view of the snowshoe binding in accordance with the second embodiment of the present invention.

FIGS. 8 and 9 illustrate a snowshoe binding in accordance with a second embodiment of the present invention. This second embodiment is substantially similar to the aforesaid first embodiment with the exception that the two binding straps 11 each have one end thereof fixedly connected to a side plate 15 that is hinged to one lateral side of the base plate 1 by a hinge 16, and an opposite end thereof coupled to the flat connection block 2.

Figure 10:
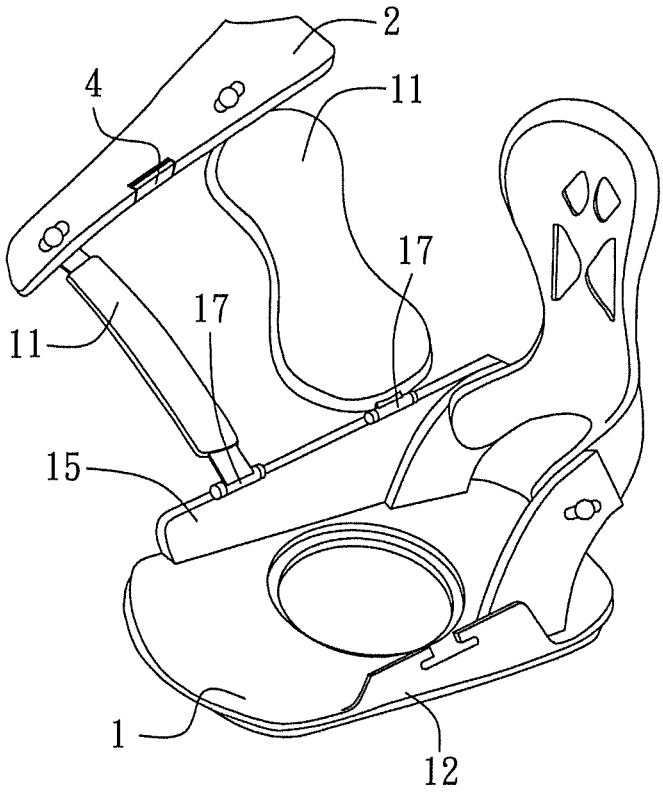
FIG. 10 is an extended out view of a part of a snowshoe binding in accordance with a third embodiment of the present invention.
Figure 11:
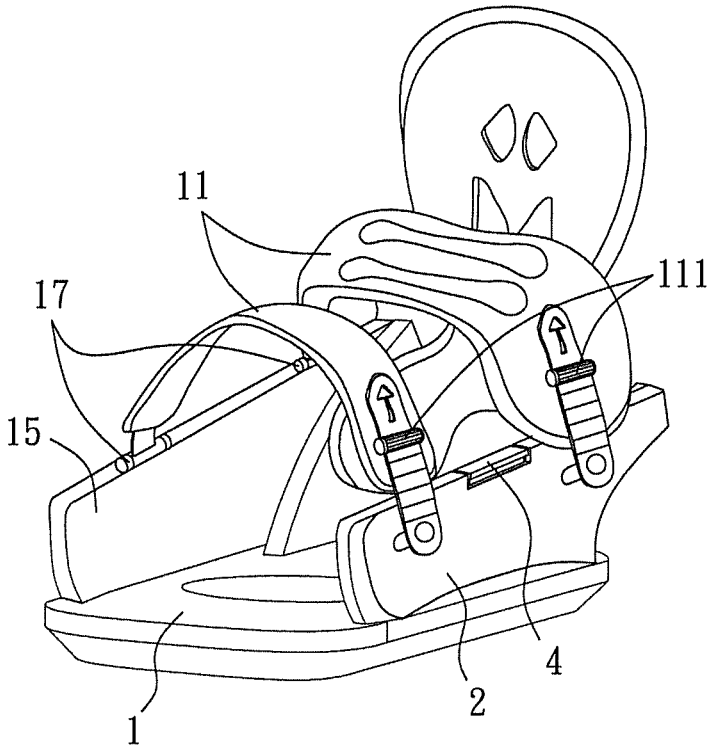
FIG. 11 is an elevational assembly view of the snowshoe binding in accordance with the third embodiment of the present invention.
Figure 12:
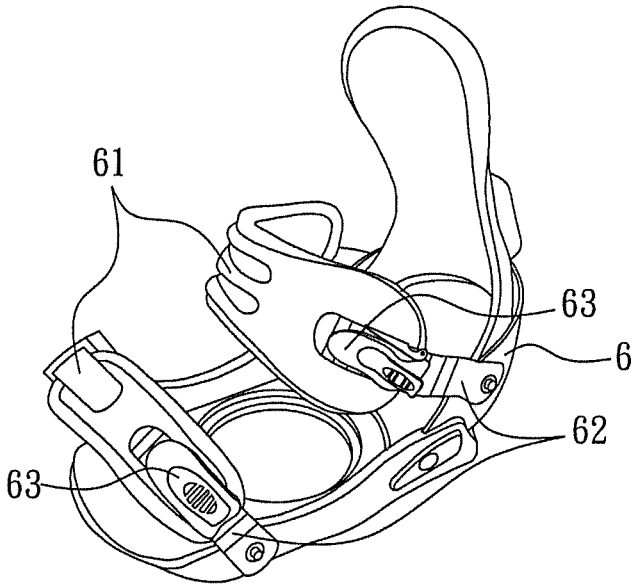
FIG. 12 PRIOR ART
FIG. 12 is an oblique elevation of a snowshoe binding according to the prior art.
Figure 13:
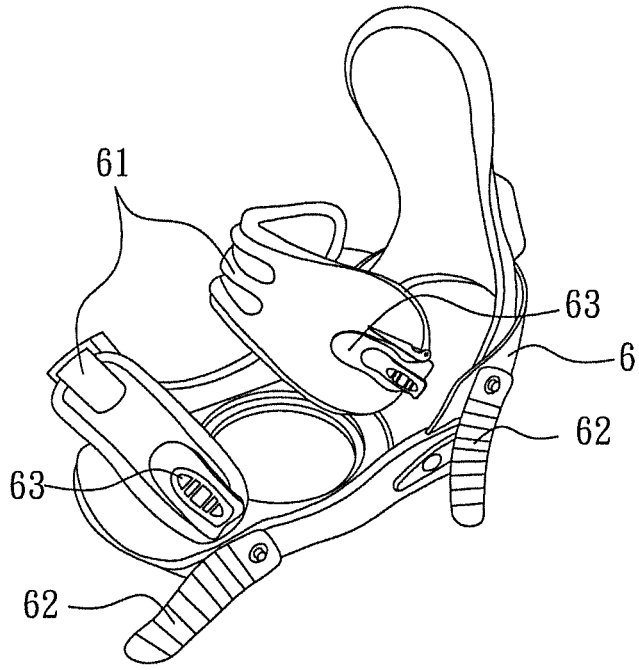
FIG. 13 PRIOR ART
FIG. 13 corresponds to FIG. 12, illustrating the toothed strips separated from the ratchets at the toe and upper straps.

FIGS. 10 and 11 illustrate a snowshoe binding in accordance with a third embodiment of the present invention. This third embodiment is substantially similar to the aforesaid second embodiment with the exception that the side plate 15 is fixedly connected to one lateral side of the base plate 1; the two binding straps 11 each have one end thereof connected to the side plate 15 by a hinge 17, and an opposite end thereof coupled to the flat connection block 2.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A snowshoe binding, comprising:

a base plate having opposing first lateral side and second lateral side and a locating block located on said second lateral side, said locating block defining an inverted T-shaped retaining hole;

a flat connection block, said flat connection block defining therein a bottom accommodation chamber adapted for accommodating said locating block;

a plurality of binding strap, each said binding strap having a first end connected to said first lateral side of said base plate and a second end coupled to said flat connection block; and a locking device adapted for detachably locking said flat connection block to said locating block;

wherein said locking device comprises:

a male buckle fixedly mounted in said bottom accommodation chamber of said flat connection for hooking in said inverted T-shaped retaining hole of said locating block, said male buckle comprising two coupling blocks connected together, two hook blocks respectively located on respective bottom sides of said two coupling blocks, two springy arms respectively downwardly extended from said upper hook blocks in a parallel manner and respectively terminating in an outwardly protruding hooked portion for hooking up with said inverted T-shaped retaining hole to lock said flat connection block to said locating block, said outwardly protruding hooked portion having a beveled guide face disposed at an outer side;

a press member coupled to said male buckle and operable to move said springy arms and said outwardly protruding hooked portions of said male buckle between an engaged position where said outwardly protruding hooked portions are hooked up with said inverted T-shaped retaining hole and a disengaged position where said outwardly protruding hooked portions are disengaged from said inverted T-shaped retaining hole, said press member comprising two coupling arms downwardly extended from a bottom side thereof in a substantially parallel manner and respectively terminating in a respective inwardly protruding hook block for hooking on said hook blocks of said male buckle, said inwardly protruding hook block defining a beveled bottom actuation edge; and a spring member set between said press member and said male buckle to impart an upward pressure to said press member relative to said male buckle and to keep the inwardly protruding hook blocks of said press member in engagement with the hook blocks of said male buckle.

2. The snowshoe binding as claimed in claim 1, wherein said locating block comprises two beveled guide edges disposed at two opposite lateral sides of a top entrance of said inverted T-shaped retaining hole and sloping downwardly toward the center of said inverted T-shaped retaining hole for guiding the outwardly protruding hooked portions of said male buckle into engagement with said inverted T-shaped retaining hole.

3. The snowshoe binding as claimed in claim 1, wherein said male buckle further comprises two arms beveled guide edges respectively downwardly extended from the hook blocks thereof along respective outer lateral sides of said springy arms for guiding movement of the beveled bottom actuation edges of said inwardly protruding hook blocks of said press member when said press member is forced downwards by an external pressure to move said springy arms and said outwardly protruding hooked portions of said male buckle from said engaged position to said disengaged position.

4. The snowshoe binding as claimed in claim 1, wherein each said binding strap has the second end thereof coupled to said flat connection block by an adjustment buckle.

5. The snowshoe binding as claimed in claim 1, wherein said base plate comprises a side plate hinged to the first lateral side thereof by a hinge; each said binding strap has the first end thereof connected to said side plate at the first lateral side of said base plate.

6. The snowshoe binding as claimed in claim 1, wherein said base plate comprises a side plate located on the first lateral side thereof; each said binding strap has the first end thereof connected to said side plate by a hinge.

* * * * *